US010661113B1

(12) United States Patent
Saunders

(10) Patent No.: US 10,661,113 B1
(45) Date of Patent: May 26, 2020

(54) AQUATIC EXERCISE SYSTEM AND METHOD

(71) Applicant: AXISENAQUA LLC, Bloomington, IN (US)

(72) Inventor: Mark Saunders, Bloomington, IN (US)

(73) Assignee: AXISENAQUA, Bloomington, IN (US)

( * ) Notice: Subject to any disclaimer, the term of this patent is extended or adjusted under 35 U.S.C. 154(b) by 8 days.

(21) Appl. No.: 16/190,690

(22) Filed: Nov. 14, 2018

(51) Int. Cl.
*A63B 21/008* (2006.01)
*A63B 9/00* (2006.01)
*E04H 4/14* (2006.01)

(52) U.S. Cl.
CPC ..... *A63B 21/0084* (2013.01); *A63B 9/00* (2013.01); *E04H 4/14* (2013.01); *A63B 2208/03* (2013.01); *A63B 2225/60* (2013.01)

(58) Field of Classification Search
CPC ... A63B 21/0084; A63B 9/00; A63B 2208/03; A63B 2225/60; A63B 31/00–18; A63B 2031/112–117; E04H 4/14
See application file for complete search history.

(56) References Cited

U.S. PATENT DOCUMENTS 2,960,335 A * 11/1960 Shuttleworth ..... A63B 69/0028 482/14
2,997,300 A * 8/1961 House ..... A63B 25/08 482/18
4,530,497 A * 7/1985 Moran ..... A63B 69/12 434/254
4,875,673 A * 10/1989 Erickson ..... A63B 1/00 482/55
4,941,659 A * 7/1990 Silvestri ..... A63B 1/00 4/496
5,037,093 A * 8/1991 Roark, Jr. ..... A63B 63/083 248/161
5,437,588 A * 8/1995 Abboudi ..... A63B 22/02 482/139
5,505,645 A * 4/1996 Engler, Jr. ..... A45B 23/00 135/16
5,860,171 A * 1/1999 Hicks ..... E04H 4/14 4/496
6,033,351 A * 3/2000 Sizemore, III ..... A63B 1/00 482/111
6,179,759 B1 * 1/2001 Tellone ..... A63B 23/0211 482/111

(Continued)

OTHER PUBLICATIONS

Screen capture of photo published on the World Wide Web of "AcquaPole" at web address: https://www.aqquatix.com/en/product/acquapole/ before Nov. 13, 2018.

*Primary Examiner* — Andrew S Lo
(74) *Attorney, Agent, or Firm* — Brannon Sowers & Cracraft PC

(57) ABSTRACT

An aquatic exercise system includes a pool and an aquatic exercise apparatus positioned in the pool. The aquatic exercise apparatus includes a base and an aquatic exercise pole having a first substantially straight section, a second substantially straight section, and a curved transition section between the first substantially straight section and the second substantially straight section. The curved transition section includes a bend, and the aquatic exercise apparatus is positioned in the pool such that bend is above a surface of water in the pool.

20 Claims, 5 Drawing Sheets

(56) References Cited

U.S. PATENT DOCUMENTS

| | | | | |
|---|---|---|---|---|
| 6,306,295 | B1 * | 10/2001 | Giacalone | E04H 4/14 210/167.2 |
| 6,383,121 | B1 * | 5/2002 | Galasso | A63B 22/0605 482/111 |
| 7,357,366 | B1 * | 4/2008 | White | A63B 71/023 248/156 |
| 7,563,206 | B1 * | 7/2009 | Bellerive | A63B 31/00 434/254 |
| 7,846,072 | B1 * | 12/2010 | Bellerive | A63B 31/00 434/254 |
| D667,514 | S * | 9/2012 | Pribelyi | E04H 4/14 D21/678 |
| 2007/0015634 | A1 * | 1/2007 | Ho | A63B 21/0084 482/54 |
| 2009/0069129 | A1 * | 3/2009 | McCarthy | A63B 24/0021 473/476 |
| 2009/0100587 | A1 * | 4/2009 | Smith | A47C 15/006 4/496 |
| 2011/0092338 | A1 * | 4/2011 | Bentley | A63B 5/06 482/18 |
| 2011/0136629 | A1 * | 6/2011 | Bellerive | A63B 31/00 482/55 |
| 2014/0155227 | A1 * | 6/2014 | Bellerive | A63B 69/12 482/55 |
| 2017/0211290 | A1 * | 7/2017 | Lupton | E04H 12/2292 |

* cited by examiner

AQUATIC EXERCISE SYSTEM AND METHOD

CROSS REFERENCE

This application claims the benefit of U.S. Provisional Patent Application No. 62/554,796 titled "AQUATIC EXERCISE AND STRETCHING APPARATUS," to Mark V. Saunders, filed Nov. 15, 2017, the entire disclosure of which is expressly incorporated by reference herein.

TECHNICAL FIELD

The present disclosure relates generally to an exercise device and, more specifically, to an aquatic exercise apparatus suitable for use in an aquatic environment.

BACKGROUND

In the United States and in many other countries throughout the world, populations are aging at a rapid pace. For example, the percentage of Americans over the age of 65 is expected to reach 20% within the next 15 years. Occurrences of aging-related health issues are therefore likely to continue to increase, likely intensifying an already burgeoning public health crisis. The elderly population is known to experience higher rates most types of health-related ailments and conditions, including, but certainly not limited to, joint and/or musculoskeletal conditions such as osteoarthritis. These types of ailments bring about their own dangers as well as their own unique challenges when developing and implementing treatment protocols. For instance, osteoarthritis, like many other musculoskeletal conditions, is typically associated with symptoms that include weakening of the muscles, diminished motor function, and reductions in overall well-being. Left untreated, these symptoms gradually worsen, typically resulting in diminished independence and quality of life. At least partially responsive to this crisis, in recent years on efforts to develop viable non-pharmaceutical therapies to facilitate traditional treatment protocols for osteoarthritis and other joint and/or musculoskeletal ailments.

Aquatic exercise programs may be one strategy available to effectively ameliorate the symptoms associated with a variety of joint and/or musculoskeletal ailments. The buoyancy experienced while patients are partially submerged reduces gravity's effect on load bearing joints making water-based treatment not only more effective but also more enjoyable for patients. Further, water-based therapies may be effective in reducing patients' pain and fatigue while increasing endurance, muscle tone, balance, and power development. Research indicates that the enjoyment experienced during exercise programs may result in higher adherence, which may be an important advantage of water-based exercise regimens over their land-based counterparts.

Barriers to implementing water-based exercise programs remain, however. For instance, many within the elderly population have difficulty maneuvering even in shallow water environments as many have already experienced muscular degeneration. This can make efforts to remain buoyant tiresome and frustrating, amongst other things. As such, there remains a need to develop systems and methods for facilitating the implementation of aquatic exercise programs that may make these types of treatments more accessible and enjoyable, ultimately making them more effective.

SUMMARY OF THE INVENTION

In one aspect, a method of setting up an aquatic exercise apparatus having an aquatic exercise pole and a base includes positioning the aquatic exercise apparatus within a pool such that a first substantially straight section of the aquatic exercise pole is at least 36 inches from each of a plurality of walls of the pool. The method further includes anchoring the aquatic exercise apparatus to a floor of the pool by way of the base, and inserting the first substantially straight section into the base such that the first substantially straight section is vertical and oriented substantially orthogonal to a water surface of the pool defining a horizontal plane, and such that a distance from the water surface to a midpoint of a curved transition section of the aquatic exercise pole is from about 1 inch to about 3 inches.

In another aspect, an aquatic exercise system includes a pool including a floor having a substantially planar section, and a plurality of walls positioned adjacent to the floor, and an aquatic exercise apparatus having a base and an aquatic exercise pole. The aquatic exercise pole has a first substantially straight section, a second substantially straight section, and a curved transition section between the first substantially straight section and the second substantially straight section, the curved transition section being formed of a rigid body material suitable for use in an aquatic environment, and the base being structured to receive the first substantially straight section. The aquatic exercise pole is coupled with the base such that the first substantially straight section is vertical and oriented substantially orthogonal to a horizontal plane, a distance between the first substantially straight section and each of the plurality of walls is at least 36 inches, and a midpoint of the curved transition section is at least 1 inch above a water level of the pool. The curved transition section has a bend angle from about 120 degrees to about 150 degrees, and a bend radius from about 4 inches to about 6 inches.

In still another aspect, an aquatic exercise apparatus includes an aquatic exercise pole having a cylindrical elongate body and a base structured to anchor the aquatic exercise apparatus to a floor of a pool. The base includes a bore for attaching the aquatic exercise pole to the base. The aquatic exercise pole has a first substantially straight section defining a first longitudinal axis, a second substantially straight section defining a second longitudinal axis, and a curved transition section between the first substantially straight section and the second substantially straight section, the curved transition section being formed of a rigid body material suitable for use in an aquatic environment. The first substantially straight section is structured to be received within the bore of the base, and includes a first end surface transverse to the first longitudinal axis. The second substantially straight section includes a second end surface transverse to the second longitudinal axis, and has a length from about 16 inches to about 20 inches from a midpoint of the curved transition section to the second end surface. The curved transition section has an outside diameter of about 1.9 inches and a bend radius from about 4 inches to about 6 inches, and is structured to couple the first substantially straight section with the second substantially straight section such that the first longitudinal axis and the second longitudinal axis intersect to form an angle from about 120 degrees to about 150 degrees.

DETAILED DESCRIPTION

Figure 1:
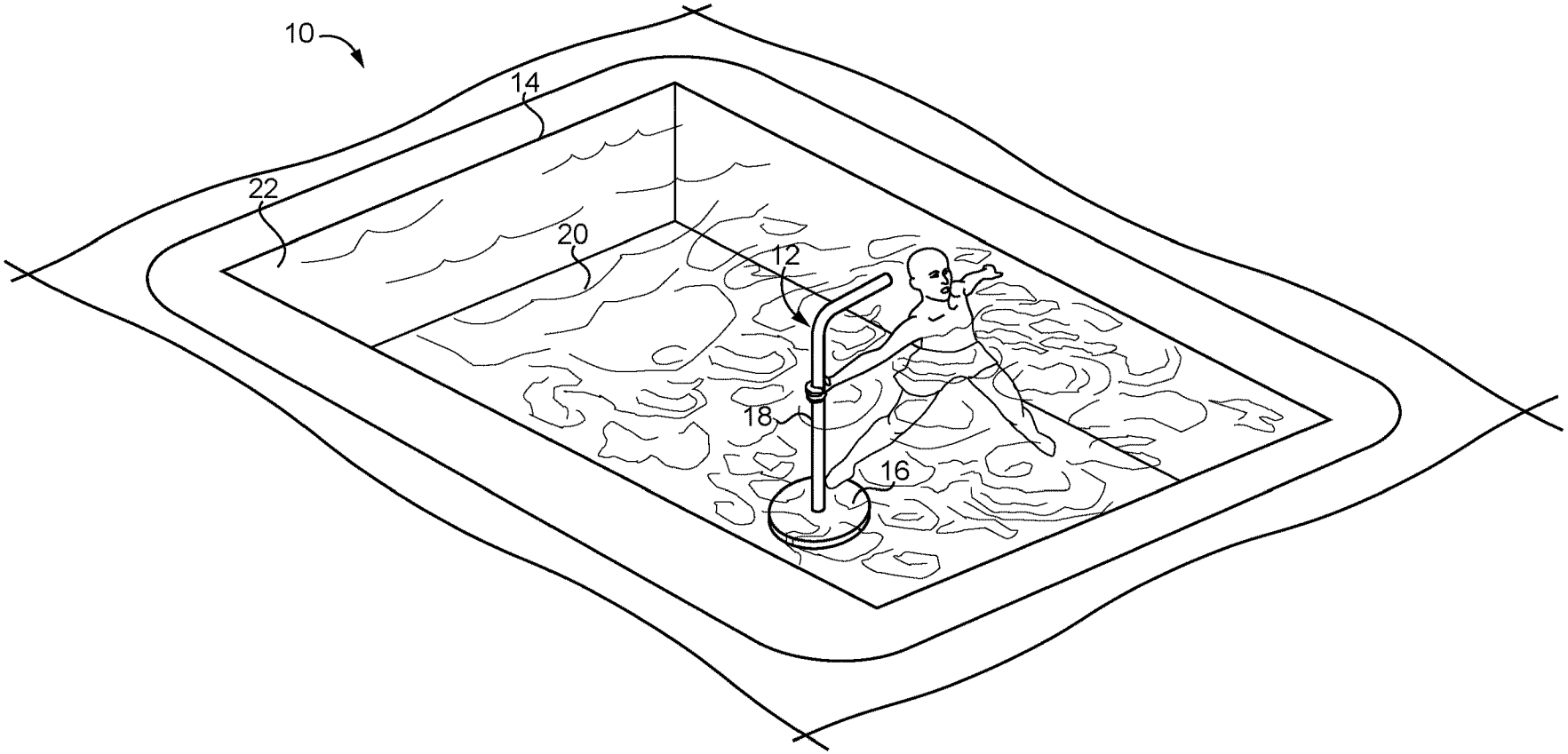
FIG. 1 is a perspective diagrammatic view of an aquatic exercise system, according to one embodiment.

Referring now to FIG. 1, a perspective view of an aquatic exercise system ("system") 10 is shown. System 10 includes an aquatic exercise apparatus ("apparatus") 12 positioned within an aquatic environment 14, which may be any type of natural or artificial structure or formation containing a volume of water. Aquatic environment 14 includes, among other things, ponds, hot tubs, baths, and pools (hereinafter, "pool 14"). Apparatus 12 includes a base 16 and an aquatic exercise pole ("pole") 18 coupled with base 16. As will be apparent from the following discussion, each apparatus 12 is structured to be deployed in a pool 14 to assist users during aquatic exercise.

Figure 2:
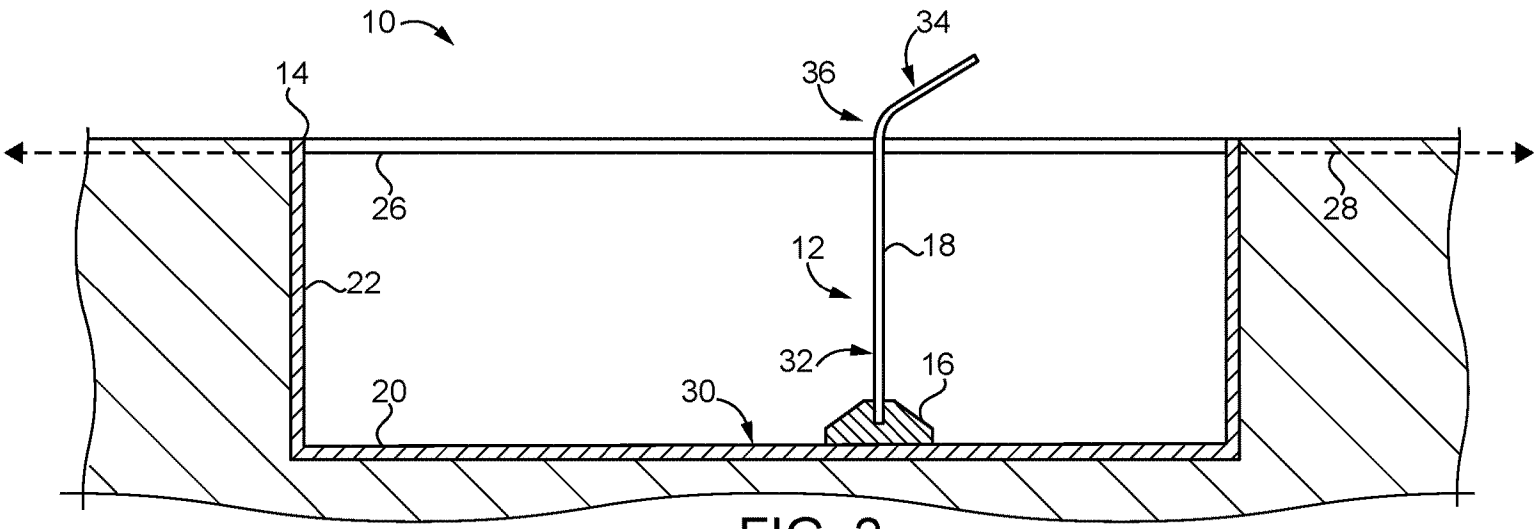
FIG. 2 is a sectioned side view of an aquatic exercise system, according to one embodiment.

Referring now also to FIG. 2, a sectioned side view of system 10 is shown. As can be seen, pool 14 may have a floor 20 and a plurality of walls 22 adjacent to floor 20. Pool includes a volume of water that has a water surface 26 defining a horizontal plane 28. Floor 20 may include at least one substantially planar section 30, although, as seen in FIG. 2, planar section 30 may be coextensive with floor 20 in some embodiments. Base 16 is structured to anchor apparatus 12 to floor 20 such that a user may be able to use pole 18 in connection with aquatic exercise routines. Apparatus 12 may be positioned in pool 14 such that a portion of pole 18 is above water surface 26, allowing users to more easily grasp onto and maintain their grip on pole 18 during use. Base 16 may be structured to movably or removably anchor apparatus 12 to floor 20. In this way, apparatus 12 can be positioned or repositioned within pool 14, or can be removed from pool 14 when not in use. Base 16 may be weighted to anchor apparatus 12. For instance, base 16 might include a built-in or removable counterweight or may include a reservoir or other structure capable of receiving sand, rocks, or any other material(s) or object(s) suitable for increasing the weight of base 16. In some embodiments, base 16 may additionally or alternatively have a relatively large circumference or perimeter such that base 16 may be able to displace and/or counter forces on pole 18 that may cause apparatus 12 to move while in use. In still other embodiments, base 16 may be structured such that weights (e.g., bricks, barbell plates, sand bags) can be placed thereon to prevent apparatus 12 from moving during use. Further still, base 16 can be equipped with one or more suction cups, or even a motorized vacuum or the like to assist in holding base 16 in place during use. A foot-actuated vacuum pump or even a vacuum pump operated by rocking of pole 18 could also be employed.

Figure 3:
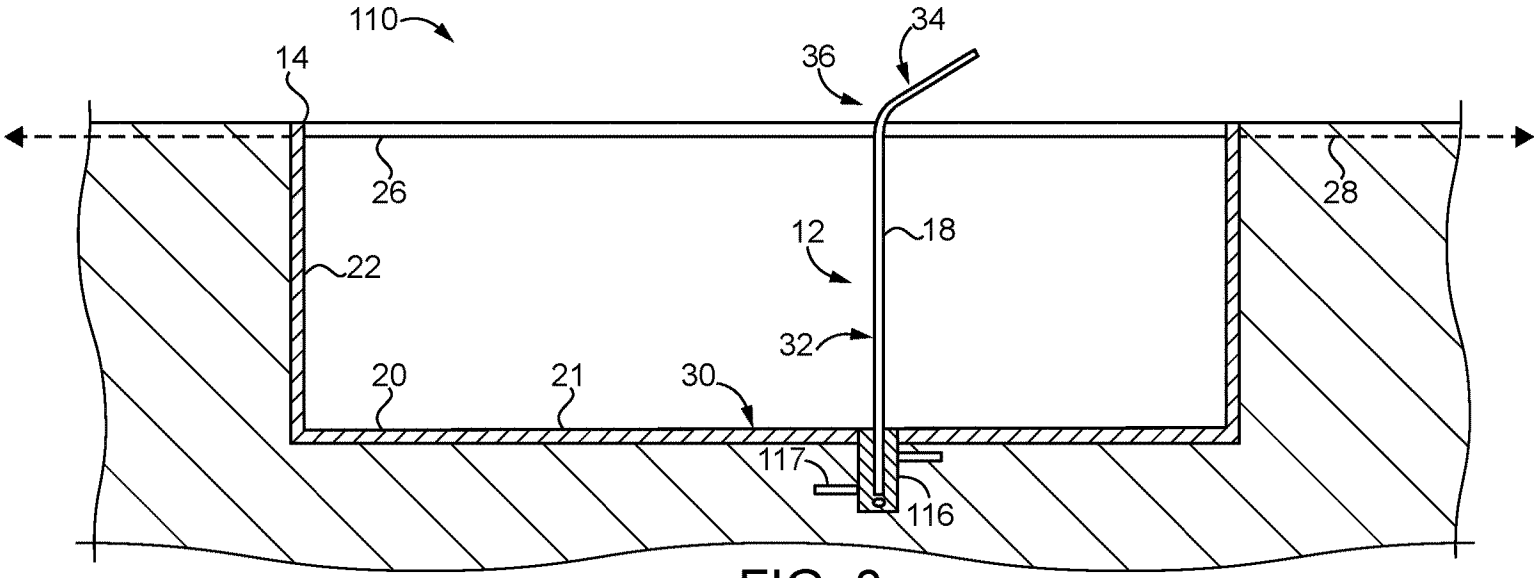
FIG. 3 is a sectioned side view of an aquatic exercise system, according to a second embodiment.

Referring now briefly to FIG. 3, an aquatic exercise system ("system") 110 is shown according to another embodiment. System 110 is similar to system 10 in many respects, except aquatic exercise apparatus ("apparatus") 112 of system 110 includes a base 116 installed within floor 20 of pool 14. Base 116 may be installed such that base 116 is at least partially below a surface 21 of floor 20. It should be noted that like reference numerals will be used to describe like features across different embodiments without further explanation, it being understood that such features may be identical in construction and function to their counterparts discussed above. Where different reference numerals are used for identical or similar features across different embodiments, the corresponding element names and numbers will be provided for reference. It should nevertheless be appreciated that no limitation is intended by way of the use of any particular reference numeral. Material differences between embodiments will be discussed herein. Absent such discussion, different embodiments should generally be understood to be alike in structure and function. Components described in connection with one embodiment may be included in other embodiments in which these components are not described or discussed. Unless expressly stated otherwise, components across embodiments having like features or functions can be understood as having like structures regardless of terminology. By way of example, base 116 might be installed by forming a bore (not numbered) within floor 20 and then fitting base 116 therein. Concrete, foam, or any other suitable material may then be used to fill any gaps between the bore hole and base 116, thereby fixing the position and location of base 116 and sealing floor 20. Base 116 might instead be installed within floor 20 while pool 14 is being constructed in some embodiments. In either case, base 116 can be fixably or permanently attached to floor 20. It will be appreciated, however, that pole 18 may still be removable from base 116 such that pool 14 can still be used for activities that do not require apparatus 112. Base 116 may include one or more stabilizing rods 117 extending therefrom to engage a matrix surrounding base 116, such as soil, rock, or the like, and are structured to prevent undesirable movement of base 116 after installation. In the present embodiment, base 116 may include four, five-inch-long stabilizing rods 117, each being equally spaced around a circumference or perimeter of base 112, and each being vertically staggered relative to the subsequent stabilizing rod 117. In other embodiments, it may be desirable to include a different number of stabilizing rods 117, to position stabilizing rods 117 differently, or perhaps not include stabilizing rods 117 at all.

Referring now again to FIGS. 1 and 2, it can be seen that pole 18 may have an elongate shape with a substantially cylindrical cross-section, although, embodiments in which the cross-sectional shape of pole 18 is oblong, polygonal, or any other shape are also contemplated. Pole 18 includes a first substantially straight section ("first section") 32, a second substantially straight section ("second section) 34, and a curved transition section ("curved section") 36 between the sections 32 and 34.

Pole 18 may have a cylindrical elongate body ("body") 38 formed at least partially from a body material that may be relatively rigid and suitable for use in an aquatic environment, such as an alloy of stainless steel. In other embodiments, the body material could include polymeric materials such as carbon fiber or fiberglass, other types or alloys of metallic materials, such as aluminum, or any other suitable material. The body material may be relatively rigid in the sense that use of pole 18 for aquatic exercise or similar activities would not be expected to result in undue plastic deformation of pole 18. For example, the body material may be structured to resist deformation of the geometry of curved section 36 while pole 18 is in use. In some embodiments, different sections might be formed of different body materials that have different relative properties or characteristics. As will be apparent from the discussion herein, it may be desirable in some instances for pole 18 to bend or flex while in use while maintaining the geometry of curved section 36. As such, in an embodiment, curved section 36 may be formed of a first body material that is structured to resist deformation, and sections 32 and 34 may be formed of a second body material structured to allow sections 32 and 34 to be flexible relative to curved section 36.

Body 38 may also be coated by a coating material in some embodiments. For example, pole 18 could be coated with a coating material structured to protect body 38 and/or the body material from corrosion or any other undesirable effects of the aquatic environment. In some embodiments, the coating material could be a resin or other type of relatively hard or rigid material structured to reinforce pole 18 and/or prevent undue deformation of one or more of sections 32, 34, 36. As can be seen in the detailed enlargement shown in FIG. 4 (discussed hereinafter), one or more of the coating materials or one or more of the body materials may be textured such that an outside surface 40 of body 38 is textured to reduce slipping when a user engages pole 18. For example, a body material or coating material within curved section 36 may be knurled or brushed to create a texture thereon that prevents slipping without unduly restricting movement on or about pole 18. In still other embodiments, the coating material itself could be applied to provide texture to pole 18. For instance, one or more of sections 32, 34, 36 could be powder coated or have a coating formed of rubber, vinyl, plastic, or any other suitable material.

Figure 4:
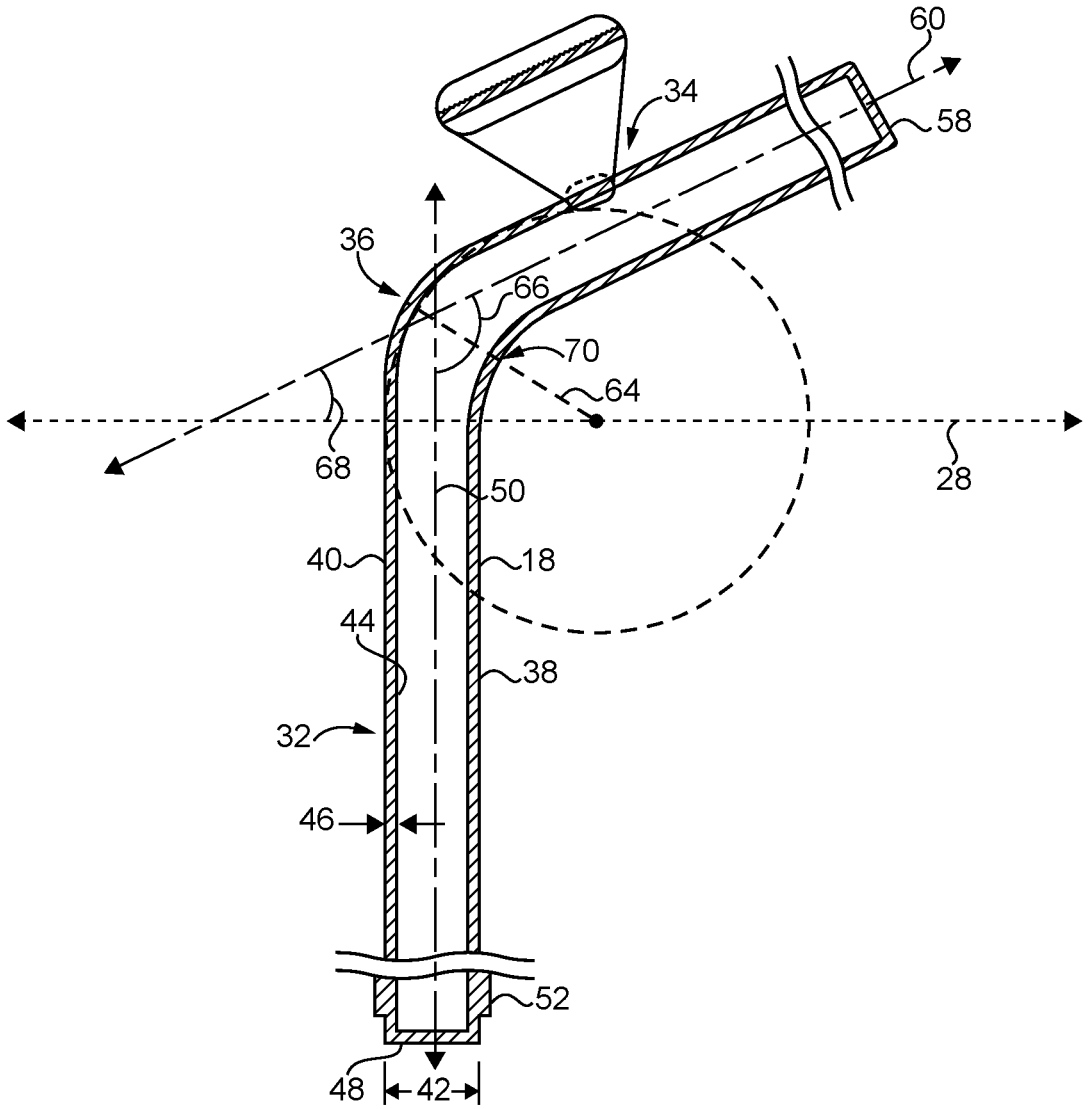
FIG. 4 is a sectioned diagrammatic view of an aquatic exercise pole, according to one embodiment.

Referring now also to FIG. 4, a close up sectioned view of pole 18 is shown, illustrating a geometry of pole 18 if cut in half along a vertical midline. Outside surface 40 of body 38 defines an outside dimension 42, which includes an outside diameter (hereinafter "outside diameter 42"). As can be seen, pole 18 may be tubular in shape or otherwise hollow such that body 38 further includes an inside surface 44, with surfaces 40 and 44 defining a wall thickness 46. The detailed enlargement in FIG. 4 illustrates example knurling in cross-section. Wall thickness 46 will typically be at least 0.1 inches, although wall thickness 46 may be greater or less than 0.1 inches in certain embodiments depending, at least in part, on the body material(s) from which body 38 is formed. For example, in an exemplary embodiment, body 38 might be formed substantially of an alloy of iron such as a stainless steel alloy, with wall thickness 46 being from about 0.1 inches to about 0.7 inches. Outside diameter 42 may be about 1.9 inches or less, although outside diameter 42 could be 2 inches or greater in other embodiments. As used herein, the term "about" can be understood in the context of conventional rounding to a consistent number of significant digits. For example, "about 0.1 inches" means from 0.14 inches to 0.05 inches, "about 1.9 inches" means from 1.94 inches to 1.85 inches, and so on. In some instances, it may be advantageous to structure or select a pole 18 having an outside diameter 42 that will permit users to maintain a grip on one or more of the sections of pole 18 while in use. As osteoarthritis and other conditions and/or symptoms common among the elderly population may make it difficult for certain elderly users to grip pole 18, it will be appreciated that elderly users may prefer or even require a pole 18 having a relatively small outside diameter 42, especially as compared to poles 18 that may be suitable for other users. By way of example, the Americans with Disabilities Act Standards for Accessible Design (ADASAD) and the International Code Council (ICC) agree that the gripping surfaces of handrails should have a diameter from 1.25 inches to 2.0 inches for handrails with a circular cross-section, and a maximum outside dimension of 2.25 inches for handrails with a non-circular cross section. Although no limitation is intended by discussion of these guidelines, it will be appreciated that, in many instances, it may advantageous to structure pole 18 in accordance with these or other rules, regulations, or other policies. Although body 28 of the present embodiment has a substantially uniform outside diameter 42 and substantially uniform wall thickness 46, in other embodiments, outside diameter 40 and/or wall thickness 46 may vary throughout body 28 and/or pole 18. For example, in an embodiment, at least one of outside diameter 42 or wall thickness 46 within first section 32 may be greater than the corresponding dimension within section 34 and/or section 36. Outside diameter 42 and/or wall thickness 46 might even vary within sections in some embodiments. In other embodiments, one or more of sections 32, 34, 36 may be solid rather than hollow such that its cross section has the shape of a circle rather than a ring.

Figure 5:
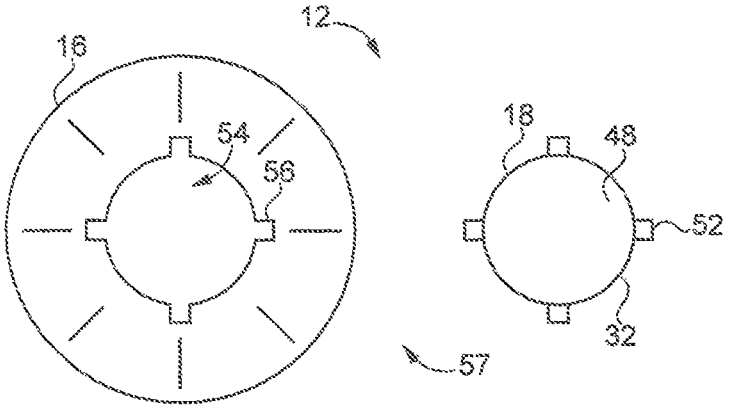
FIG. 5 is a diagrammatic view of an aquatic exercise apparatus, according to one embodiment.

First section 32 includes an end surface 48 structured to be received by base 16, and defines a longitudinal axis 50 extending from end surface 48 towards curved section 36. Referring now also to FIG. 5, end surface 48 may be substantially planar and transverse to longitudinal axis 50, although embodiments in which end surface 48 has a different geometry are also contemplated. First section 32 may be manufactured or otherwise formed such that end surface 48 is integral with body 38, or first section 32 may have a cap or analogous formation thereon, with end surface 48 being resident on the cap/formation. In still other embodiments, first section 32 may be open such that end surface 48 has the same shape as does a cross section of body 38 within first section 32.

Base 16 may include a bore 54 formed therein, with bore 54 being structured such that pole 18 may be vertical within pool 14, and oriented substantially orthogonal to horizontal plane 28 when attached to base 16. For example, if floor 20 is angled relative to horizontal plane 28, bore 54 may be formed within base 16 at an angle complementary to the angle of floor 20. In this way, pole 18 may be oriented substantially orthogonal to horizontal plane 28 even if floor 20 is not parallel with horizontal plane 28. As can be seen, first section 32 may also include one or more fins 52 on body 38 within first section 32, with bore 54 including one or more recesses 56 that correspond with and are structured to receive fins 52. Fins 52 may include pins, poles, hooks, latches, or any other type of projection, and recesses 56 may include bores, holes, openings, or any other type of similar formation. In some embodiments, pole 18 may include recesses 56, with bore 54 including the corresponding fins 52. Fins 52 and recesses 56 may form a locking mechanism 57 structured to allow base 16 to detachably engage pole 18 so as to prevent pole 18 from becoming dislodged from base 16 while apparatus 12 is in use. In an exemplary embodiment, base 16 may be structured to receive pole 18 such that end surface 48 is seated within bore 54, and pole 18 can be rotated around longitudinal axis 50 to engage locking mechanism 57. In such an embodiment, pole 18 could be disengaged by rotation of pole 18 around longitudinal axis 50 in an opposite direction. In this way, pole 18 can be removed from base 16 when not in use. In other embodiments, locking mechanism 57 could be structured differently. For example, locking mechanism 57 could include a spring latch mechanism structured to engage pole 18 when end surface 48 is seated within bore 54, or could include any other suitable mechanism for locking pole 18 together with base 16. In still other embodiments, pole 18 might be fixably attached to base 16, or base 16 might not include a locking mechanism at all. It is contemplated that most embodiments will include a first transverse surface on pole 18, and a second transverse surface on base 16 positioned in opposition to the first transverse surface. Such transverse surfaces may be on internal and external threads of either of pole 18 or base 16, on or in fin(s) 52 and recess(es) 56, or have still another configuration.

Figure 6:
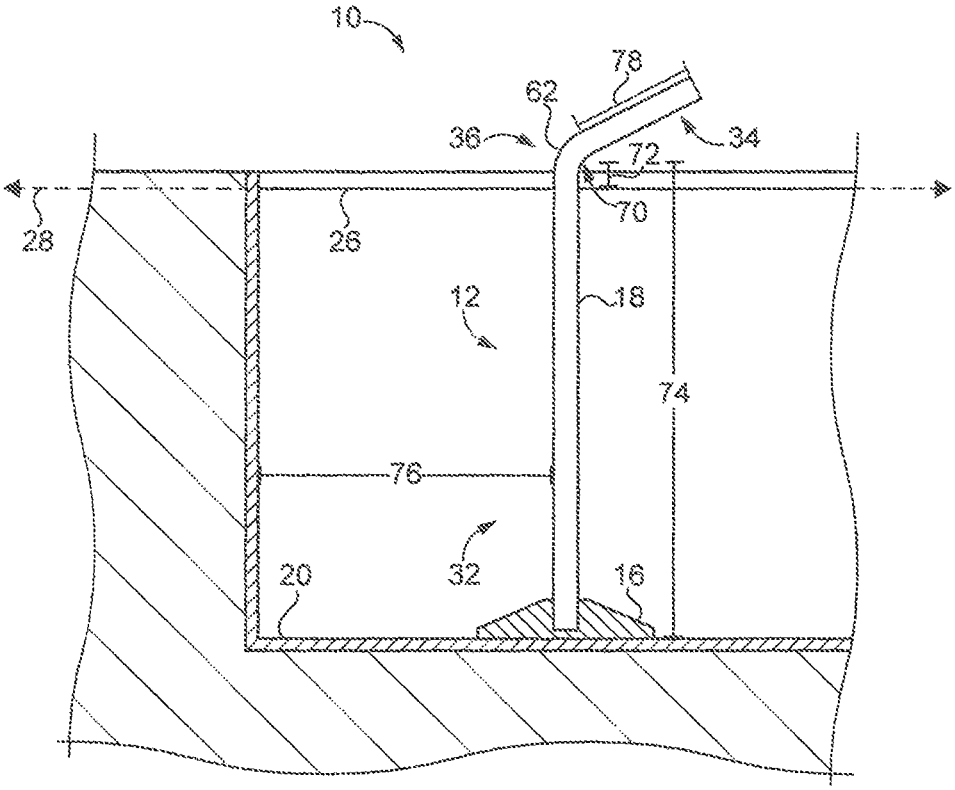
FIG. 6 is a sectioned side view of an aquatic exercise system, according to one embodiment.

Second section 34 may be similar to first section 32 in many respects. Like first section 32, second section 34 has an end surface 58 and a substantially straight elongate body 38 defining a longitudinal axis 60 extending from end surface 58 within elongate body 38 towards curved section 36. End surface 58 may also be transverse to longitudinal axis 60. In an exemplary embodiment, end surface 58 may be a free end of pole 18 in that end surface 58 is not coupled with or engaged by any other structure. Second section 34 may have a length 78 (as shown in FIG. 6, discussed hereinafter) from about 16 inches to about 20 inches as measured from end surface 58 to a bend midpoint 70 (shown in FIG. 6, discussed hereinafter) of curved section 36. In other embodiments, second section 34 may be shorter than about 16 inches or longer than about 20 inches. For example, the embodiment shown in FIG. 7 (discussed hereinafter) has a second section 234 that may be longer than second section 34, might not include end surface 58, and/or may attached to additional sections or segments of pole 18 or other structures.

Curved section 36 couples first section 32 with second section 34 to form a bend 62 in pole 18. In many embodiments, section 32, 34, 36 will be integrally formed and may have substantially similar dimensions and/or material compositions although, as discussed above, embodiments in which curved section 36 is structured differently than section 32 or 34 are also contemplated. As will be discussed herein, it has been discovered that forming bend 62 in pole 18 may provide advantages not present in poles without a bend formed in accordance with the present disclosure. Bend 62 has an outer bend radius 64 from about 4 inches to about 6 inches, although embodiments in which outer bend radius 64 is about 4 inches or less, or about 6 inches or more are also contemplated. Bend 62 further defines a bend angle 66 of about 120 degrees to about 150 degrees, and can be understood as the angle formed at the intersection of longitudinal axis 50 and longitudinal axis 60. Accordingly, second section 34 may be angled relative to horizontal plane 28 at an angle 68 from about 30 degrees to about 60 degrees. Bend 62 further defines bend midpoint ("midpoint") 70 inside bend 62. In other words, as can be seen in FIG. 4, if outer bend radius 64 bisects bend angle 66, midpoint 70 is the point at which outer bend radius 64 crosses outside surface 40 inside bend 62.

Figure 7:
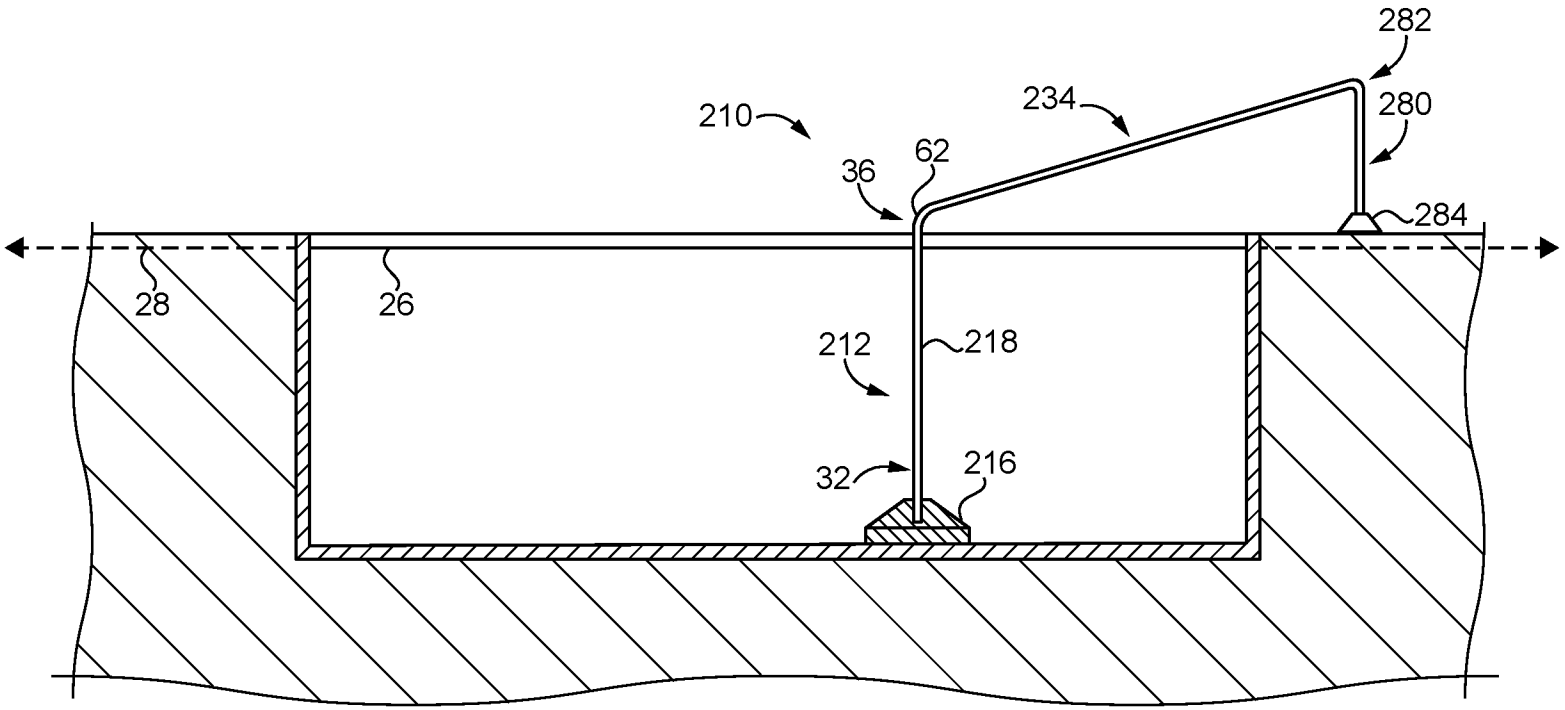
FIG. 7 is a sectioned side view of an aquatic exercise system, according to a third embodiment.

Referring now briefly to FIG. 7, a system for aquatic exercise ("system") 210 is shown according to a third embodiment. System 210 is similar to system 10 in many respects, except aquatic exercise apparatus ("apparatus") 212 of system 210 includes both a first base 216 and a second base 284. Further, aquatic exercise pole ("pole") 218 of system 210 includes a third substantially straight section ("third section") 280 that may be substantially parallel with first section 32, and a second curved transition section ("second curved section") 282 between second substantially straight section ("second section") 234 and third section 280. Second base 216 may be positioned outside pool 14 and structured to receive an end surface (not shown) of third section 280. In this way, first base 216 may be coupled with second base 284 by way of pole 218. In some embodiments, first base 216 may be identical to base 16 of system 10. In other embodiments, first base 216 may be structured differently than base 16, however. For instance, first base 216 might not be weighted, at least not to the same extent as base 16, as the dual base structure of apparatus 212 may reduce the likelihood of apparatus 212 moving during use.

Referring now also to FIG. 6, a partially sectioned side view of system 10 is shown, illustrating an exemplary position of apparatus 12 within pool 14. System 10 may be deployed in pools 14 having various dimensions. Generally, a water depth (i.e., distance between floor 20 and water surface 26) of at least chest height is recommended when engaging in aquatic exercise. As such, system 10 may be deployed in a pool 14 having a water depth of about 36 inches or greater, although system 10 can be deployed in a pool having a water depth of about 28 inches in some instances. As will become apparent from the discussion herein, bend 62 should be positioned above water surface 26 when pole 18 is within base 16. More specifically, it has been discovered that apparatus 12 may be most effective if a distance 72 between midpoint 70 and water surface 26 is from about 1 inch to about 3 inches. In some embodiments, it may be desirable to have bend 62 positioned less than about 1 inch or more than about 3 inches above water surface 26, however. In some embodiments, apparatus 12 may be structured to have a distance 74 between midpoint 70 and floor 20 of about 29 inches or greater. In other words, distance 74 may be substantially equal to the sum of distance 72 and the water depth of pool 14. As such, in an exemplary embodiment, distance 74 may be from about 37 inches to about 45 inches, depending on the water depth of pool 14.

Referring now to the drawings generally, a method of setting up apparatus 12 within pool 14 may include positioning apparatus 12 such that first section 32 is a distance 76 from each of walls 22, wherein distance 76 is at least 36 inches. As discussed below, using apparatus 12 during aquatic exercise routines may require a minimum amount clearance such that users can freely maneuver. In some embodiments of system 10, two or more apparatuses 12 may be used in a single pool 14, in which case each pole 18 may be positioned such that each first section 32 is at least about 72 inches from the first section 32 of any neighboring poles 18 such that each apparatus 12 has sufficient clearance for its user to exercise.

Once positioned within pool 14, apparatus 12 can then be anchored to floor 20 by allowing base 16 to come to rest on floor 20, by adding weighted objects and/or materials to base 16, or by installing base 16 within floor 20. Once base 16 has been anchored, pole 18 can be attached to base 16 by inserting first section 32 into bore 54 such that end surface 58 may be seated therein. Pole 18 can be locked into base 16 in embodiments in which apparatus 12 includes locking mechanism 57 by, for instance, rotating pole 18 relative to base 16. Pole 18 may be attached to base 16 such that pole 18 is oriented substantially orthogonal to horizontal plane 28 and distance 74 is from about 31 inches to about 35 inches. It will be appreciated that embodiments in which pole 18 is structured to attach to a different type of base 16 are also contemplated. For example, pole 18 may be structured to attach to a base or analogous structure of existing exercise equipment, such that pole 18 may be used without having to anchor base 16. In some embodiments, the position of apparatus 12 may be adjusted within pool 14 to achieve a suitable distance 74. In other embodiments, apparatus 12 may be configured or positioned to achieve a suitable distance 72 in addition to or in lieu of distance 74. For example, in some embodiments, the water depth of pool 14 may be 43 inches or greater. In some embodiments, setting up apparatus 12 may further include filling pool 14 with water such that pool 14 has a sufficient water depth and/or inserting third section 280 in second base 284.

Once apparatus 12 has been set up in pool 14, a user may be able to use pole 18 to assist in the performance of aquatic exercises. In many aquatic exercises, such as leg swings, flutter kicks, planks, body hangs, and the like, users hold onto pole 18 while moving their lower extremities (e.g., legs). To engage in such maneuvers, users—especially elderly users—typically must have a firm grip on a fixed object. While certain types of aquatic exercise equipment may be useful in facilitating aquatic exercising in some instances, it has been observed that many known strategies cannot provide adequate support, or are difficult to use or store. Apparatus 12, however, can be positioned and repositioned within pool 14, which may assist in accommodating a wider range of users. For instance, many pools, particularly publicly accessible pools, have varying water depths. A location within the pool suitable for use by one user may not be suitable for use by a subsequent user because the water may be too deep or too shallow.

Additionally, pole 18 includes bend 62, which may allow users to more effectively grasp apparatus 12 while exercising. For example, for some exercises, it may be desirable for users to grasp pole 18 above bend 62, which may allow the user to more easily remain buoyant without having to discontinue exercising to reestablish their grip. For other exercises, it may be desirable to grasp below bend 62, while in still other exercises, it may be desirable to place one hand above and one hand below bend 62. Bend 62 may also allow apparatus 12 to be used in conjunction with a wider array of aquatic exercises. For instance, some types of exercise equipment may include only a single gripping surface that is vertically oriented, and which may make it difficult for certain users to do certain exercises, such as body hangs. In some embodiments, portions of pole 18 may additionally be textured as discussed herein to further assist users in maintaining their grip on pole 18 during use.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A method of setting up an aquatic exercise apparatus including an aquatic exercise pole and a base, comprising:

positioning the aquatic exercise apparatus within a pool such that a first substantially straight section of the aquatic exercise pole is at least 36 inches from each of a plurality of walls of the pool;

anchoring the aquatic exercise apparatus to a floor of the pool by way of the base; and inserting the first substantially straight section into the base such that the first substantially straight section is vertical and oriented substantially orthogonal to a water surface of the pool that defines a horizontal plane, and such that a distance from the water surface to a midpoint of a curved transition section of the aquatic exercise pole is from about 1 inch to about 3 inches.

2. The method of claim 1 wherein anchoring the aquatic exercise apparatus further includes installing the base within the floor of the pool such that the base is at least partially below a surface of the floor.

3. The method of claim 1 further including filling the pool with water such that the pool has a depth of at least 28 inches between the floor and the water surface.

4. The method of claim 1 further including positioning the aquatic exercise apparatus such that a distance from the midpoint of the curved transition section to the floor of the pool is from about 31 inches to about 35 inches.

5. The method of claim 1 further including positioning the aquatic exercise apparatus within the pool such that a second substantially straight section of the aquatic exercise pole has an angle from about 30 degrees to about 60 degrees relative to the horizontal plane.

6. The method of claim 1 wherein the aquatic exercise apparatus includes a second base, a third section, and a second curved transition section between the second substantially straight section and the third section, and method further including coupling the third section to the second base.

7. The method of claim 6 further including positioning the second base outside of the pool.

8. An aquatic exercise system, comprising:

a pool including a floor having a substantially planar section, and a plurality of walls positioned adjacent to the floor; and an aquatic exercise apparatus including an aquatic exercise pole having a first substantially straight section, a second substantially straight section, and a curved transition section between the first substantially straight section and the second substantially straight section, and a base structured to receive the first substantially straight section, the curved transition section being formed of a rigid body material;

the aquatic exercise pole being coupled with the base such that the first substantially straight section is vertical and oriented substantially orthogonal to a horizontal plane, a distance between the first substantially straight section and each of the plurality of walls is at least 36 inches, and a midpoint of the curved transition section is at least 1 inch above a water level of the pool; and the curved transition section having a bend angle from about 120 degrees to about 150 degrees, and a bend radius from about 4 inches to about 6 inches.

9. The system of claim 8 wherein the aquatic exercise apparatus includes a locking mechanism structured to allow the base to detachably engage the first substantially straight section of the aquatic exercise pole.

10. The system of claim 9 wherein the first substantially straight section includes a first transverse surface, and the base includes a bore structured to receive the first substantially straight section, and a second transverse surface positioned in facing opposition to the first transverse surface.

11. The system of claim 8 wherein the base is installed within the floor of the pool such that the base is at least partially below a surface of the floor.

12. The system of claim 8 wherein the second substantially straight section defines a longitudinal axis and further includes an end surface transverse to the longitudinal axis.

13. The system of claim 12 wherein a length of the second substantially straight section from the midpoint of the curved transition section to the end surface is from about 16 inches to about 20 inches.

14. The system of claim 8 wherein the rigid body material includes an alloy of iron.

15. The system of claim 8 wherein the rigid body material is a first body material and at least one of the first substantially straight section or the second substantially straight section is formed of a second body material that is flexible relative to the first body material.

16. The system of claim 8 wherein the curved transition section has an outside diameter of about 1.9 inches.

17. The system of claim 8 wherein the curved transition section is at least partially textured.

18. The system of claim 8 wherein the aquatic exercise pole further includes a third section and a second curved transition section between the second substantially straight section and the third section.

19. The system of claim 18 further including a second base positioned outside the pool and structured to receive the third section of the aquatic exercise pole.

20. An aquatic exercise apparatus, comprising:

an aquatic exercise pole including a cylindrical elongate body; and a base structured to anchor the aquatic exercise apparatus to a floor of a pool, and including a bore for attaching the aquatic exercise pole to the base;

the aquatic exercise pole including a first substantially straight section defining a first longitudinal axis, a second substantially straight section defining a second longitudinal axis, and a curved transition section between the first substantially straight section and the second substantially straight section, the curved transition section being formed of a rigid body material;

the first substantially straight section being structured to be received within the bore of the base, and including a first end surface transverse to the first longitudinal axis;

the second substantially straight section including a second end surface transverse to the second longitudinal axis, and having a length from about 16 inches to about 20 inches from a midpoint of the curved transition section to the second end surface; and the curved transition section having an outside diameter of about 1.9 inches and a bend radius from about 4 inches to about 6 inches, and being structured to couple the first substantially straight section with the second substantially straight section such that the first longitudinal axis and the second longitudinal axis intersect to form an angle from about 120 degrees to about 150 degrees.

* * * * *